US005755604A

United States Patent [19]

Borgersen

[11] Patent Number: 5,755,604

[45] Date of Patent: May 26, 1998

[54] BOAT PROPELLER DRIVE UNIT

[75] Inventor: Kjell Borgersen, Hjälteby, Sweden

[73] Assignee: AB Volvo Penta, Gothenburg, Sweden

[21] Appl. No.: 775,244

[22] Filed: Dec. 30, 1996

[30] Foreign Application Priority Data

Dec. 28, 1995 [SE] Sweden ..... 9504673

[51] Int. Cl.[6] ..... B63H 5/125

[52] U.S. Cl. ..... 440/56; 440/53; 440/57

[58] Field of Search ..... 440/49, 53, 57, 440/61, 63, 56

[56] References Cited

U.S. PATENT DOCUMENTS 3,893,407 7/1975 Hurst ..... 440/57

4,645,464 2/1987 Rawlings ..... 440/57

4,654,013 3/1987 Bland et al. ..... 440/57

*Primary Examiner*—Jesus D. Sotelo

*Attorney, Agent, or Firm*—Young & Thompson

[57] ABSTRACT

Boat propeller drive unit, comprising a frame-like carrier (1) intended to be fixedly joined to a boat transom, and a propeller rig (4) which is suspended in a fork (13) for trim and tilting movement relative to the fork about a horizontal axis (a). The fork in turn is mounted in the carrier for pivoting about a vertical steering axis (b). A pair of hydraulically operated piston cylinder devices (18,20) are pivotally joined at opposite ends to the rig (4) and to the legs (12) of the fork.

5 Claims, 1 Drawing Sheet

BOAT PROPELLER DRIVE UNIT

FIELD OF THE INVENTION

The present invention relates to a boat propeller drive unit, comprising a frame-like carrier intended to be fixedly mounted to a boat transom, a fork-like carrying element mounted in the carrier for pivoting about a first axis, a propeller rig, which is mounted in the fork-like carrying element for pivoting about a second axis perpendicular to the first axis, and pressure medium actuated operating means, which act between the frame-like carrier and the propeller rig to permit variation in a vertical plane of the positional angle of the rig relative to the frame-like carrier.

BACKGROUND OF THE INVENTION

Known boat propeller drive units of this kind can be divided into two main types as regards the suspension of the propeller rig itself. In one known type, which is marketed under the trademark Aquamatic®, a fork has legs which are mounted in a frame-like carrier to permit pivoting of the fork about a horizontal axis running transverse to the rig. The propeller rig is mounted in the fork to pivot about a steering axis lying in a vertical plane. In a second known type, the rig suspension is reversed, i.e. a fork is mounted in upper and lower bearings for pivoting about a vertical axis relative to a carrier (the transom), while the rig is mounted in the fork to pivot about a transverse horizontal axis. In both cases one type has advantages which the other one lacks. The solution with a tipping fork has the advantage that no particular supporting surfaces for the rig are required when it is heavily trimmed out. The design with a steerable fork makes possible on the other hand placement of the steering axis bearing points at a greater distance from each other, thus increasing the ability to take up torque.

In hitherto known propeller drive units of the sort described in the introduction and of the type which has a steerable fork, the fork is mounted relative to the boat transom in such a way that the entire steering movement of the fork occurs outside the transom since the steering axis lies entirely outside the transom. In comparison with known propeller drive units of the first mentioned type, this will mean that the rig and consequently also the propeller will be placed further aft of the transom.

SUMMARY OF THE INVENTION

The purpose of the present invention is to achieve a boat propeller drive unit of the sort described by way of introduction which combines the best characteristics of the two types described above without any of the negative effects.

This is achieved according to the invention by virtue of the fact that said first axis is a steering axis lying in a vertical plane, that the fork-like carrying element is mounted in the frame-like carrier in upper and lower bearing points for pivoting about the steering axis, that the upper bearing point lies forward of the plane of the carrier which is intended to be in contact with the boat transom, that the second axis is horizontal and the pressure medium actuated operating means are attached to the rig and to the fork to pivot, when actuated, the rig relative to the fork about the second axis.

In a drive unit of this type the propeller will be closer to the boat transom than in known drive units of this type, which has a fork mounted in upper and lower bearings in the boat transom. The invention is based on the insight that the propeller should be placed as close to the transom as possible in order to work in a waterflow which is a nearly parallel to the boat bottom as possible and not in an upwardly directed waterflow which fills the water trough behind the boat. Such placement further aft will give an excentric load on the propeller due to the fact that one side works with the current in an upwardly directed waterflow while the other side of the propeller works against the flow.

BRIEF DESCRIPTION OF THE DRAWINGS

The invention will be described in more detail below with reference to examples shown in the accompanying drawings, where.

DETAILED DESCRIPTION OF THE INVENTION

The drive units shown in the Figures are of so-called Aquamatic® type and comprise a frame-like carrier 1, which has a frame portion 2 intended to be fixed to a transom with its surface 3*a* in sealing contact with the edge of an opening in the transom. The frame portion 2 is cast in one piece with the cover 3 lying inside it which, when the carrier 1 is mounted, extends into the opening in the transom and to which the engine flywheel cover is securely bolted.

Figure 1:
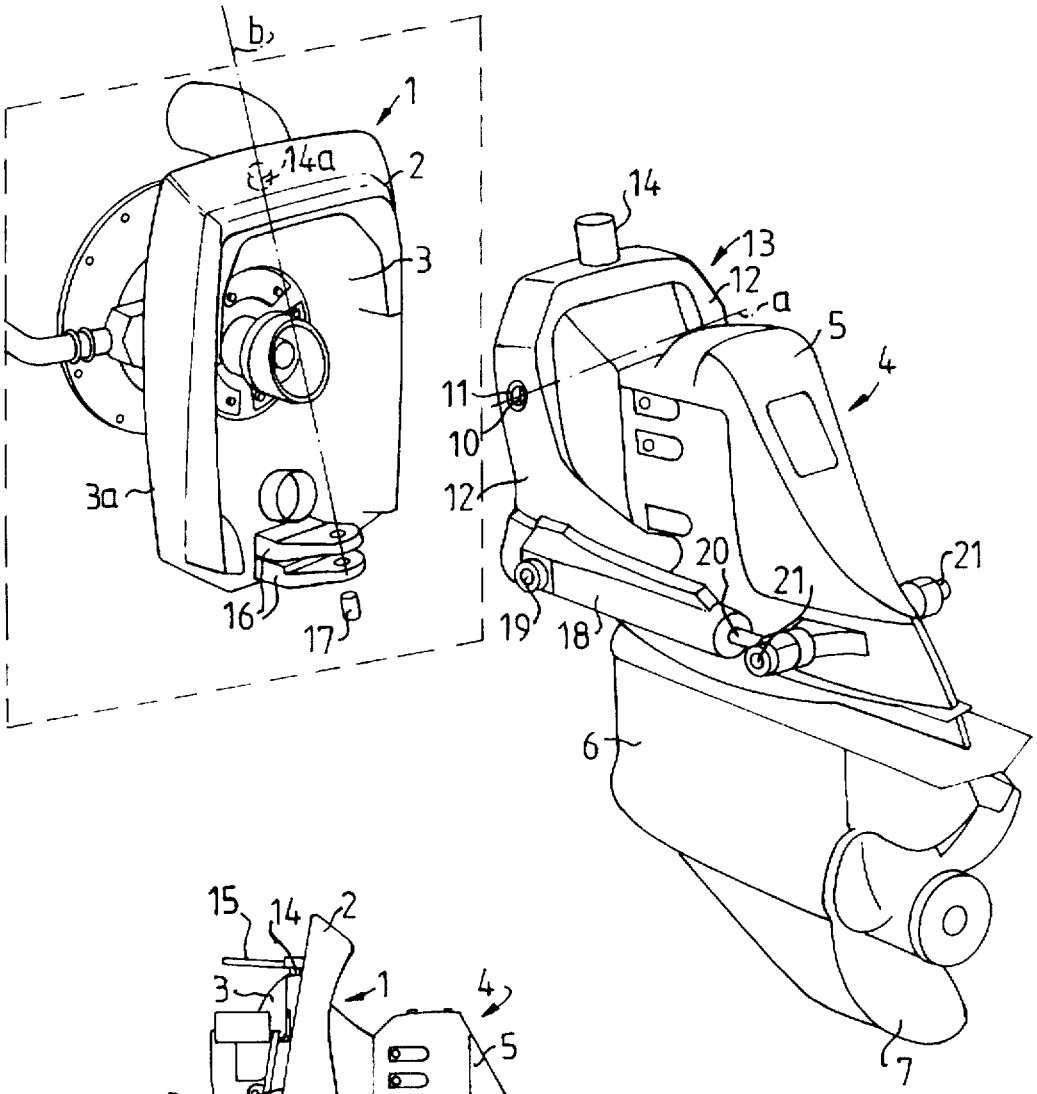
FIG. 1 shows in perspective an exploded view of one embodiment of a boat propeller drive unit according to the invention with one propeller and FIG. 2 shows a sideview of a corresponding propeller drive unit with double propellers.
Figure 2:
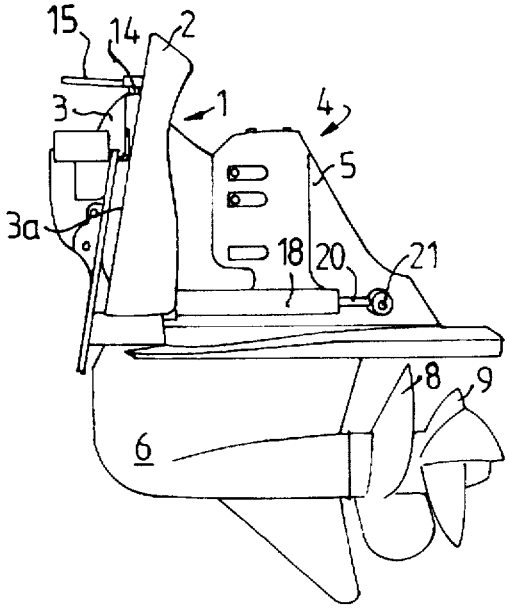

The drive unit also comprises a propeller rig, generally designated 4, which has an upper gear housing 5 containing a first angle gearing with a reversing mechanism (not shown) and a lower gear housing 6 containing a second angle gearing and propeller shaft (not shown), on which a propeller 7 (FIG. 1) is mounted. The drive unit in FIG. 2 has two concentric shafts (not shown) for two propellers 8, 9. The upper gear housing 5 of the propeller rig 4 has a pair of trunnions 10 which are pivotally mounted in openings 11 in opposite legs 12 of a carrying fork generally designated 13 to permit pivoting of the rig relative to the fork about a horizontal pivot axis "a". The fork 13 has an upper stub shaft 14 for mounting the fork in a bearing 14*a* in the upper portion of the frame cover 3 (see FIG. 2). On a portion of the stub shaft 14 extending above the upper surface of the cover 3 a steering arm 15 is fixed. The legs 12 are joined at their lower ends to each other by means of a transverse beam (not shown) which, when the rig 4 is suspended in the frame 1, lies in the intermediate space between two flanges 16 on the frame portion 2 of the carrier. A pin 17 extends through an opening in the transverse beam and is fixed between the flanges 16. The pin 17 has an axis of symmetry coinciding with the axis of symmetry of the stub shaft 14, thus forming the steering axis "b " of the rig 4. The steering axis "b " lies in a vertical plane and by virtue of the arrangement described of the stub shafts 14, 17 will be inclined obliquely forward so that it intersects the transom plane of the carrier 1 approximately in the middle.

A pair of hydraulically operated piston cylinder devices 18, 20 are arranged on either side of the upper gear housing 5 symmetrically with regard to its longitudinal centre plane. The cylinders 18 are pivotally connected to pins 19 at the lower ends of the legs 12 of the fork 13, while the piston rods 20 are pivotally connected to pins 21 on the upper gear housing 5.

With the aid of the piston cylinder devices 18, 20 the trim angle of the rig relative the boat is adapted to the running position of the boat. When stationary, they are used to tilt the lower gear housing and the propeller out of the water. By virtue of the fact that the cylinders 18 are attached to the fork 13 they will follow the steering movement.

I claim:

1. Boat propeller drive unit, comprising a frame-like carrier intended to be fixedly mounted to a boat transom, a fork-like carrying element mounted in the carrier for pivoting about a first axis, a propeller rig, which is mounted in the fork-like carrying element for pivoting about a second axis perpendicular to the first axis, and pressure medium actuated operating means, which act between the frame-like carrier and the propeller rig to permit variation in a vertical plane of the positional angle of the rig relative to the frame-like carrier, wherein the first axis is a steering axis (b) lying in a vertical plane, the fork-like carrying element (13) is mounted in the frame-like carrier (1) in upper and lower bearing points (14*a*,17) for pivoting about the steering axis, the upper bearing point (14) lies forward of the plane (3*a*) of the carrier intended to be in contact with the boat transom, the second axis (a) is horizontal and the pressure medium actuated operating means (18,20) are attached to the rig (4) and to the fork-like carrying element (13) to pivot, when actuated, the rig relative to the fork-like carrying element about the second axis.

2. Boat propeller drive unit according to claim 1, wherein the lower bearing point (17) of the carrier in the frame-like carrier is located aft of the upper bearing point (14*a*), so that the steering axis (b) when the carrier (1) is mounted, intersects the plane of the transom.

3. Boat propeller drive unit according to claim wherein the carrier (1) comprises a frame portion (2), which, when the carrier is mounted, surrounds an opening in the boat transom, and a cover (3) joined to the frame, which extends through said opening, and wherein the upper bearing (14*a*) of the steering axis (b) lies in the cover and its lower bearing lies in the frame portion.

4. Boat propeller drive unit according to claim 3, wherein the fork-like carrier element (13) has an upper stud shaft (14) which is mounted in the cover (3) and has a portion extending above the cover to which a steering arm (15) is fixed.

5. Boat propeller drive unit according to claim 1, wherein the pressure medium actuated operating means comprise a pair of piston cylinder devices (18,20) which are arranged parallel to each other on either side of the propeller rig (4) and have ends pivotally fixed to opposite sides of the rig and opposite ends pivotally fixed to opposite legs (12) of the fork-like carrier element (13).

* * * * *